United States Patent [19]

Stewart

[11] Patent Number: 4,651,627

[45] Date of Patent: Mar. 24, 1987

[54] FLUID-PRESSURE OPERATED ACTUATORS

[75] Inventor: Duncan R. Stewart, Gloucestershire, England

[73] Assignee: Hytork Actuators Limited, Gloucester, England

[21] Appl. No.: 828,565

[22] Filed: Feb. 10, 1986

Related U.S. Application Data

[63] Continuation of Ser. No. 683,044, Dec. 18, 1984, abandoned, which is a continuation of Ser. No. 401,376, Jul. 23, 1982, abandoned.

[30] Foreign Application Priority Data

Aug. 1, 1981 [GB] United Kingdom ..... 8123604

[51] Int. Cl.[4] ..... F15B 15/24

[52] U.S. Cl. ..... 92/13.7; 92/69 R; 92/75; 92/136

[58] Field of Search ..... 92/13, 13.3, 13.6, 13.7, 92/69 R, 69 A, 69 B, 74, 136, 138, 50, 75, 120, 121; 74/109

[56] References Cited

U.S. PATENT DOCUMENTS

| | | | |
|---|---|---|---|
| 3,498,187 | 3/1970 | Stringfellow | 92/136 |
| 3,704,986 | 12/1972 | Sheesley et al. | 92/138 |
| 3,797,324 | 3/1974 | Sheesley et al. | 92/138 |
| 3,818,808 | 6/1974 | Shafer | 92/138 |
| 3,971,296 | 7/1976 | Tugwell | 92/69 R |
| 4,199,344 | 4/1980 | Mumford et al. | 92/13.7 |
| 4,586,392 | 5/1986 | Nilsson | 74/109 X |

FOREIGN PATENT DOCUMENTS 1157209 7/1969 United Kingdom .

*Primary Examiner*—Robert E. Garrett
*Assistant Examiner*—Williamson
*Attorney, Agent, or Firm*—William R. Hinds

[57] ABSTRACT

A fluid-pressure operated actuator comprises a housing, at least one piston reciprocable in the housing, a rotatable output shaft having a portion thereof within the housing, means operatively connecting the piston and the output shaft, and stop means mounted on the housing and engageable with the shaft portion for limiting rotary movement of the shaft.

6 Claims, 5 Drawing Figures

FLUID-PRESSURE OPERATED ACTUATORS

This application is a continuation, of application Ser. No. 683,044, filed Dec. 18, 1984, which is a continuation of Ser. No. 401,376, filed July 23, 1982, both abandoned.

This invention relates to fluid-pressure operated actuators.

One form of fluid-pressure operated actuator comprises a housing, at least one piston reciprocable within the housing, a rotatable output shaft having a portion thereof within the casing, and a linkage operatively connecting the piston or pistons to said portion of the output shaft. In operation, fluid under pressure is introduced into the housing and moves the piston or pistons in one direction or the other. This movement of the piston or pistons is transmitted by the linkage to the output shaft so that the latter is rotated to operate, for example, a fluid control valve to which the actuator is connected.

In such actuators, it is desirable to provide means to limit the rotational stroke of the output shaft in an adjustable manner, so that the rotational stroke of the output shaft can be matched exactly to equipment operated by the actuator. For example, where the actuator operates a fluid control valve including a valve member and a valve seat, the output shaft should reach one end of its stroke just as the valve member comes into engagement with the valve seat. Conventionally, the piston movement is limited by stops which act directly on the piston or pistons. Not only is such an arrangement expensive, but also in order to adjust the limits in both directions of movement of the piston or pistons, separate and often quite different operations using special tools must be performed at relatively distant points on the casing, which considerably complicates the adjustment procedure. Moreover, due to the inevitable play between the various parts of the linkage connecting the piston or pistons to the output shaft, a given limiting position of the piston or pistons set by means of the stops may not correspond to a repeatable rotational position of the output shaft, so that it becomes difficult to match the throw of the output shaft exactly to the equipment which the actuator operates.

It has been proposed to limit rotational movement of the output shaft directly by means of stops which act on a part of the shaft disposed externally of the housing. However, other items such as limit switches or a position indicator are usually provided on this part of the output shaft, and it becomes difficult to adjust the stops without disturbing these items or the equipment to which the actuator is connected. In extreme cases it is impossible to effect the adjustment on-site with the actuator under fluid pressure.

It is an object of the present invention to obviate or mitigate these problems.

According to the present invention, a fluid-pressure operated actuator comprises a housing, at least one piston reciprocable in the housing, a rotatable output shaft having a portion thereof within the housing, means operatively connecting the piston and the output shaft, and a stop means mounted on the housing and engageable with the shaft portion for limiting rotary movement of the shaft.

The stop means may be adjustable.

The stop means may comprise two spaced stops respectively engageable with abutments on the shaft portion for limiting rotary movement of the shaft in two opposed senses.

The or each stop can be formed by an end of a threaded bolt which is received in a correspondingly threaded bore provided either in the housing proper or in a member secured to the external surface of the housing. Where two such bolts are provided, their heads are preferably positioned closely adjacent one another on the housing exterior.

In one particular arrangement, the operative connection comprises a rack on the or each piston which meshes with a pinion on said portion of the output shaft. The stop means can engage directly with the pinion in which case the gear teeth thereof can serve as the abutment or abutments. Alternatively the abutments can be provided separately from the pinion, for example by being made integral with said portion of the output shaft or by being provided on a separate plate which is keyed to said portion of the output shaft for rotation therewith.

In an alternative arrangement, the operative connection comprises a scotch yoke wherein a yoke is mounted on said portion of the output shaft so as to be rotatable therewith and a pin on the or each piston slidably engages in a respective slot in the yoke. The stop means can engage the yoke directly in which case the abutment or abutments are provided on the yoke itself, or the abutment or abutments can be provided on a plate which is separate from the yoke and which is keyed to said portion of the output shaft for rotation therewith.

The actuator is advantageously of the type which includes a pair of pistons which move in opposite directions to rotate the output shaft.

The invention may be performed in various ways and some specific embodiments with possible modifications will now be described, by way of example, with reference to the accompanying drawings, in which.

Figure 1:
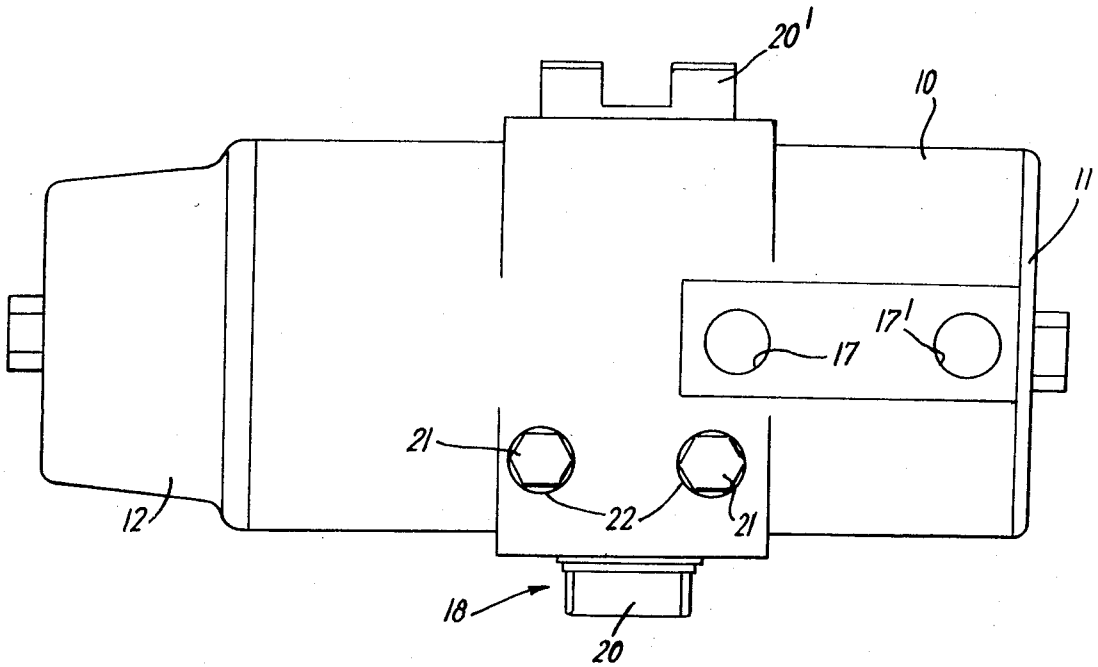
FIG. 1 is a plan view of a fluid-pressure operated actuator according to the present invention.
Figure 2:
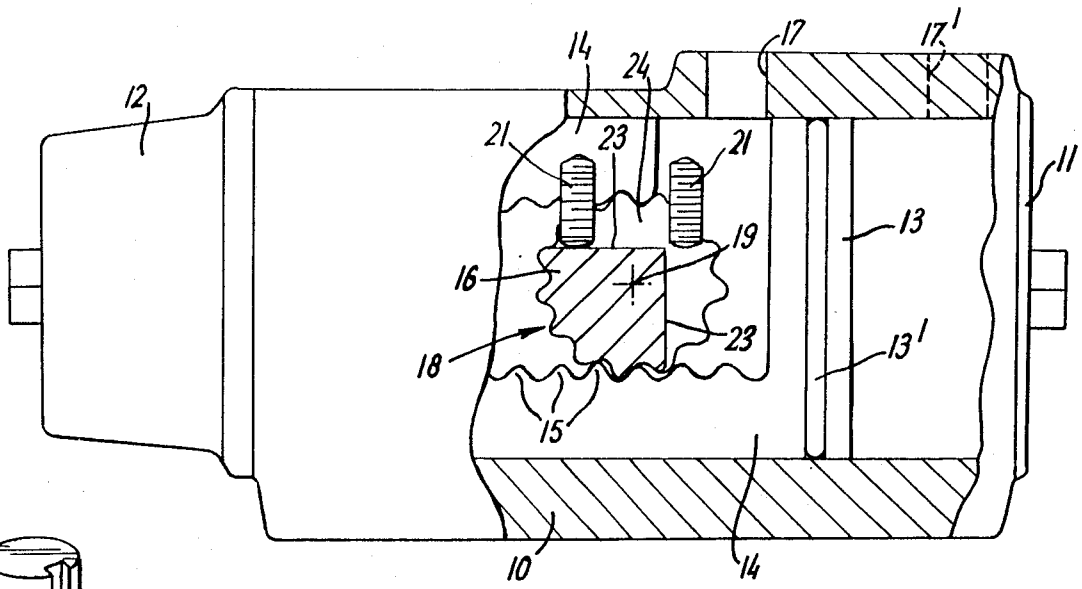
FIG. 2 is a side view, partly in section, of the actuator shown in FIG. 1.
Figure 4:
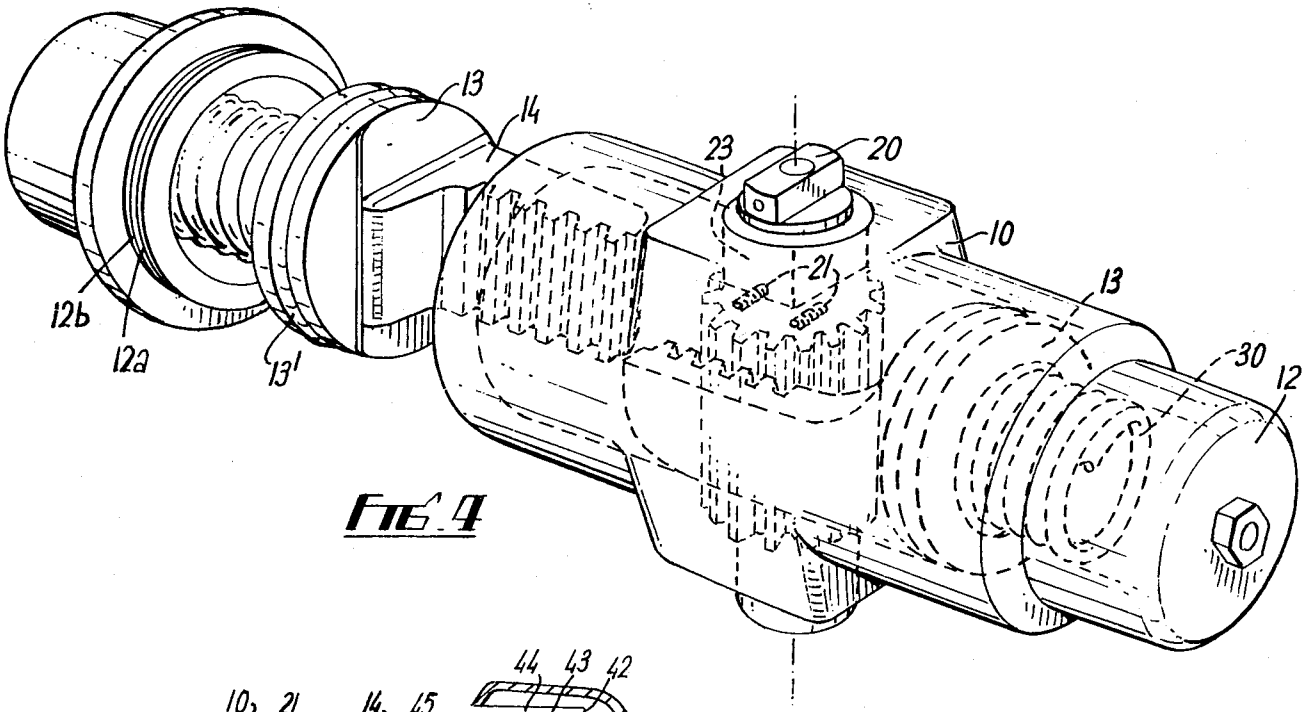
FIG. 4 is a partly exploded view of another actuator.

Referring first to FIGS. 1 and 2, the actuator shown therein comprises a tubular casing or housing 10 whose open ends are closed in a fluid-tight manner by an end cap 11 and a domed end cover 12, respectively. A pair of pistons 13 are slidably located for axial reciprocatory movement within the housing 10. Each piston 13 has an offset axial extension 14 on which are formed rack gear teeth 15, the piston extensions being disposed such that the racks 15 face one another across the width of the housing. Each piston includes a peripheral O-ring seal 13' engaging the casing 10. Disposed between and meshed with the two racks 15 is a pinion gear 16, which is rotated by movement of the two pistons 13 in opposite directions. A fluid supply port 17 is provided in the casing 10 whereby fluid, for example air, under pressure can be supplied between the pistons 13 to move them apart and rotate the pinion in one sense. A return spring (see 30, FIG. 4) is housed within the end cover 12 and biasses the other piston to the right, as viewed in FIG. 2. This biassing action is transmitted by the pinion 16 to bias the illustrated piston 13 to the left so that on release of pressure at port 17 the spring moves the pistons towards each other and rotates the pinion in the opposite sense. In an alternative the end 12 is replaced by an end cap 11 and supply ports 71' are provided on the outside of the pistons, the ports 17' being connected together so that pressure can be supplied to ports 17,17' to move the pistons in the two directions. The cover 12 (see FIG. 4). includes a peripheral O-ring seal **12*a* sealingly engaging the inner surface of the housing 10. A circlip 12*b*** is received in confronting peripheral recesses in the cover and housing and may take the form of a stainless steel flexible coiled spring cut to the appropriate length; this minimises stress concentration, and cannot be pre-stressed unlike nuts and bolts.

An output shaft 18 of the actuator is mounted in the housing 10 for rotation about an axis 19 transverse to the direction of movement of the pistons 13 and has at its ends respective dogs 20, 20' by means of which it can be coupled to the equipment (such as a fluid flow control valve) to be operated by the actuator. The pinion gear 16 is provided on a portion of the shaft 18 which is disposed within the casing 10, and may be formed as an integral part of the output shaft or may be a separate component which is keyed to the shaft for rotation therewith.

In order to limit the rotational stroke of the output shaft 18 in both directions, a pair of adjustable stops are provided which engage angularly spaced abutments on the part of the shaft 18 located within the housing 10 for limiting rotary movement of the shaft in two opposed senses. In the embodiment shown in FIGS. 1 and 2, the adjustable stops are constituted respectively by a pair of threaded bolts 21 which are received with lock nuts and seals (not shown) through threaded bosses 22 in the housing, and the abutments are formed respectively by a pair of angled surfaces 23 at the base of a slot 24 machined through the pinion gear 16. The rotational stroke of the output shaft 18 in each direction is limited by engagement of the end of a respective one of the bolts 21 with a respective one of the surfaces 23, such as is illustrated in FIG. 2, and each limit can be adjusted simply by screwing the appropriate bolt 21 in one direction or the other. The bolts 21 are located so as not to obstruct movement of the pistons, and are spaced apart less than the diameter of the output shaft and gear 16 within the housing.

The illustrated actuator is designed primarily for operating fluid flow control valves of the ball, butterfly or plug type, and accordingly the stops provided by the bolts 21 and the abutments provided by the surfaces 23 are arranged to give a rotational stroke of approximately 90° for the output shaft 18. However, the stops and abutments may be suitably arranged to provide any desired angular stroke for the output shaft, depending upon the intended use of the actuator.

Because a pair of bolts are provided as the above-mentioned stops, adjustment of the stops is achieved in a simple manner and, moreover, in contrast to conventional arrangements wherein the stops act directly on the pistons, the same adjustment procedure (i.e. a simple tightening or loosening action) is employed for both stops. Furthermore, it will be noted from FIG. 1 that the heads of the bolts are disposed closely adjacent one another on the casing exterior, which greatly facilitates the adjustment operation, at one side of the actuator so that the adjusting bolts are clear of the dogs 20,20' and the equipment operatively connected to the dogs.

In the construction described above, the bolts 21 are received by threaded bosses on the housing proper. In an alternative arrangement, however, the bolts can be received by threaded bores in a member which is bolted or otherwise secured to the housing exterior, and can pass through plain bores in the housing itself.

Also in the above described construction the abutments are constituted by the base surfaces 23 of a machined slot in the pinion gear. The slot may, however, be dispensed with and abutments can instead be provided by two angularly spaced gear teeth of the pinion, with clearances being machined in the intervening gear teeth to prevent obstruction of the bolt ends. As a further alternative, the abutments need not be provided on the pinion gear at all, but can instead be provided separately from the pinion on the part of the output shaft 18 within the housing. For example, the abutments could be cast onto or otherwise formed integrally with the shaft. Where the pinion gear is separate from and keyed to the output shaft, the abutments can be formed on a plate which is also keyed to the output shaft for rotation therewith about the axis 19.

Figure 3:
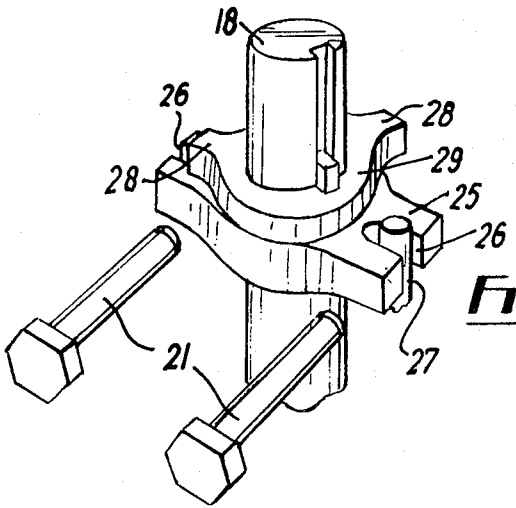
FIG. 3 is a perspective view of part of a modified form of fluid-pressure operated actuator, also according to the present invention.

FIG. 3 illustrates part of a modified actuator, wherein movement of the pistons is transmitted to the output shaft 18 by means of a scotch yoke assembly instead of by means of meshing rack and pinion gears. The scotch yoke assembly comprises a yoke 25 which is keyed to the output shaft 18 for rotation therewith and which has a pair of opposed slots 26 therein. Pins 27 (only one shown) respectively secured to the pistons are slidably received in the slots 26 so that they can move radially along the length of the slots 26 as the yoke 25 rotates, whilst transmitting movement of the pistons to the yoke. Apart from this, the construction of the actuator is generally identical to that described above with reference to FIGS. 1 and 2. As in the previously described arrangement, adjustable stops and corresponding abutments are provided to limit movement of the pistons and hence the rotational stroke of the output shaft. In the illustrated construction, the adjustable stops are again constituted by a pair of threaded bolts 21, while the abutments are formed by two angularly spaced lugs 28 on a plate 29 which is keyed to the output shaft 18 for rotation therewith. Movement of the pistons in each direction is limited by engagement of the end of a respective one of the bolts 21 with a respective one of the lugs 28. The angular spacing between the lugs 28 will determine the nominal rotational stroke of the output shaft 18, and can be chosen having regard to the intended use of the actuator. In the illustrated construction, as with the embodiment of FIGS. 1 and 2, the actuator is primarily intended for use with ball, butterfly or plug valves and the nominal stroke of the output shaft is 90°. The bolts 21 are shown a little spaced from the plate 29 for clarity.

In an alternative arrangement, the plate 29 can be omitted and the lugs 28 can instead be cast onto or otherwise integrally formed with the output shaft 18. As a further alternative, the lugs 28 can be provided integrally with the yoke 25. Furthermore, instead of being provided separately from the output shaft, the yoke 25 can be formed as an integral part thereof.

Figure 5:
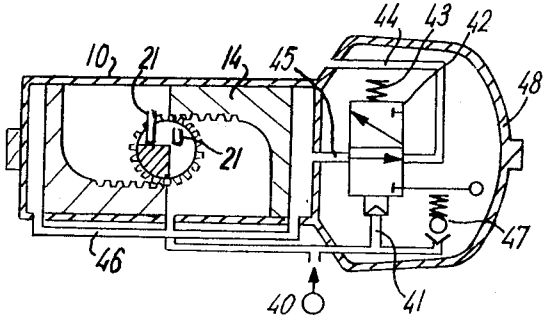
FIG. 5 is a schematic view of a further actuator.

The invention can also be employed in a fluid-operated actuator shown in FIG. 5. In this actuator on the power stroke, pressure fluid is supplied at 40 and moves the pistons apart, as shown, to one limit of movement, fluid pressure in passage 41 moves valve 42 against spring 43 to connect the interior of the casing 10 outside the piston heads to exhaust through passages 44, valve 42, passages 45, 46. Also, fluid pressure opens non-return valve 47 to raise the pressure in cap 48 to supply pressure.

Should the fluid supply at 40 fail, valve 47 closes, the spring 43 moves the valve 42 to connect the air in cap 48 to passages 45, 46 through valve 42 and passage 44 is blocked. Thus each piston receives full supply pressure from cap 48 and the pistons move towards each other up to the other limit stop, rotating shaft 18 to open or close the associated valve.

It will be understood that the actuator may have a single piston. For example the left-hand piston of FIG. 2 may be omitted.

The stops 21 could be axially spaced along the pinion.

The above-described embodiments have many advantages compared with conventional actuators. For example, because the adjustable stops act directly on the output shaft or on components mounted thereon, as opposed to acting on the pistons, the rotational stroke of the output shaft can be set accurately so as to conform to the operational requirements of the equipment it operates. User convenience is greatly improved since, as mentioned above, the same procedure is utilized for adjustment of both ends of the output stroke and the adjustments are made at closely adjacent positions on the casing exterior. Moreover, adjustment of the stops is achieved without the use of any special tools, and can be performed while the actuator is installed and under pressure, there being no need to disconnect the actuator from the equipment it operates which might otherwise result in disturbance of ancillary items, such as limit switches or position indicators provided on the output shaft externally of the housing.

I claim:

1. A fluid pressure operated, rotary shaft, valve actuator comprising a housing, a rotatable output shaft having a portion thereof within the housing, the shaft portion comprising pinion teeth, abutments on the shaft portion, two opposed pistons mounted for reciprocation in the housing, an offset axial extension on each piston, each of which extensions is formed with rack teeth which respectively engage said pinion teeth on opposite sides of said output shaft portion, two adjustable stops adjacent said racks and spaced apart less than the diameter of the output shaft portion, said stops being engageable with said abutments on the shaft portion to limit rotation of the output shaft, said stops being adjustable exterior to said housing.

2. An actuator as claimed in claim 1 in which the abutments are within the axial extent of said pinion teeth.

3. An actuator as claimed in claim 1 in which each stop comprises a threaded member extending into the housing so that rotation of said member adjusts the stop.

4. An actuator as claimed in claim 1 wherein said abutments are located in at least one cut-out slot in said shaft portion.

5. An actuator as claimed in claim 4 wherein said cut-out slot is in said pinion teeth.

6. An actuator as claimed in claim 1 wherein said adjustable stops are threaded members generally parallel to each other and extending outwardly through said housing to terminate in exterior adjustment ends, such that said exterior adjustment ends are closely adjacent each other on the exterior of said housing to facilitate access and ready adjustment.

* * * * *